US005269373A

United States Patent [19]

Sagawa et al.

[11] Patent Number: 5,269,373

[45] Date of Patent: Dec. 14, 1993

[54] HEAT EXCHANGER

[75] Inventors: Tomohiko Sagawa, Kanagawa; Ryuichi Seino, Ibaragi, both of Japan

[73] Assignees: Nissan Motor Co., Ltd., Yokohama; Hitachi, Ltd., Tokyo; Hitachi Automotive Engineering Co., Ltd., Ibaragi, all of Japan

[21] Appl. No.: 718,470

[22] Filed: Jun. 20, 1991

[30] Foreign Application Priority Data

Jun. 20, 1990 [JP] Japan ..... 2-161868

[51] Int. Cl.[5] ..... F28D 1/053

[52] U.S. Cl. ..... 165/149; 165/153; 165/903

[58] Field of Search ..... 165/149, 153, 903

[56] References Cited

U.S. PATENT DOCUMENTS

| | | | |
|---|---|---|---|
| 4,484,622 | 11/1984 | Satchwell | 165/153 |
| 4,614,231 | 9/1986 | Proctor | 165/153 |

FOREIGN PATENT DOCUMENTS

| | | | |
|---|---|---|---|
| 2435736 | 3/1975 | Fed. Rep. of Germany | 165/153 |
| 164996 | 9/1983 | Japan | 165/149 |
| 55565 | 3/1986 | Japan . | |
| 2098313 | 11/1982 | United Kingdom | 165/149 |

*Primary Examiner*—Albert W. Davis, Jr.
*Attorney, Agent, or Firm*—Pennie & Edmonds

[57] ABSTRACT

A condenser comprises a plurality of tubes arranged between a pair of header pipes, and a plurality of fins divided into a first group and a second group, the first group being arranged between the plurality of tubes, and two plates arranged between the pair of header pipes at lower end portions thereof for holding the second group.

1 Claim, 2 Drawing Sheets

HEAT EXCHANGER

BACKGROUND OF THE INVENTION

The present invention relates to a heat exchanger such as a condenser for air conditioning of an automotive vehicle.

Referring to FIGS. 3 and 4, there is shown a condenser C for an automotive vehicle of the parallel flow type which includes a plurality of tubes 2 between a pair of header pipes 1 arranged at a predetermined interval, and a plurality of fins 3 for heat release, each being arranged between the tubes 2 (see JP-A 61-55565, for example).

Arranged under the condenser C is a cross member 4 which partly surrounds the condenser C, and has a portion corresponding to a lower end of the header pipe 1, which is formed to extend obliquely.

Accordingly, each header pipe 1 of the condenser C has a lower outside end obliquely cut to prevent interference with the cross member 4.

A cap 5 is secured to each header pipe 1 having a U-shaped cross section at the lower end thereof to close same. A radiator is designated by a reference numeral 6.

With such known condenser C, however, due to the obstructive presence of a periphery of the cap 5, the tube 2 cannot be inserted in a lower end portion of each header pipe 1 at which the cap 5 is located, resulting in an obligatory upward displacement of the bottom tube 2.

Thus, there is a clearance or space A between the cross member 4 and the bottom tube 2 of the condenser C, through which a part of incoming air passes, resulting in a corresponding decrease in effect of heat release of the condenser C.

It is, therefore, an object of the present invention to provide a heat exchanger which has more improved efficiency of heat exchange.

SUMMARY OF THE INVENTION

According to one aspect of the present invention, there is provided a heat exchanger including a pair of header pipes, comprising:

a plurality of tubes arranged between the pair of header pipes, said plurality of tubes fluidly communicating with the pair of header pipes;

a plurality of fins divided into a first group and a second group, said first group being arranged between said plurality of tubes; and plate means for holding said second group, said plate means being arranged between the pair of header pipes at one end portions thereof.

According to another aspect of the present invention, there is provided a condenser for an air conditioning system for an automotive vehicle, the condenser including a pair of header pipes, comprising:

a plurality of tubes arranged between the pair of header pipes, said plurality of tubes fluidly communicating with the two header pipes;

a plurality of fins divided into a first group and a second group, said first group being arranged between said plurality of tubes; and plate means for holding said second group of fins, said plate means being arranged between the pair of header pipes at one end portions thereof.

DETAILED DESCRIPTION OF THE INVENTION

Figure 1:
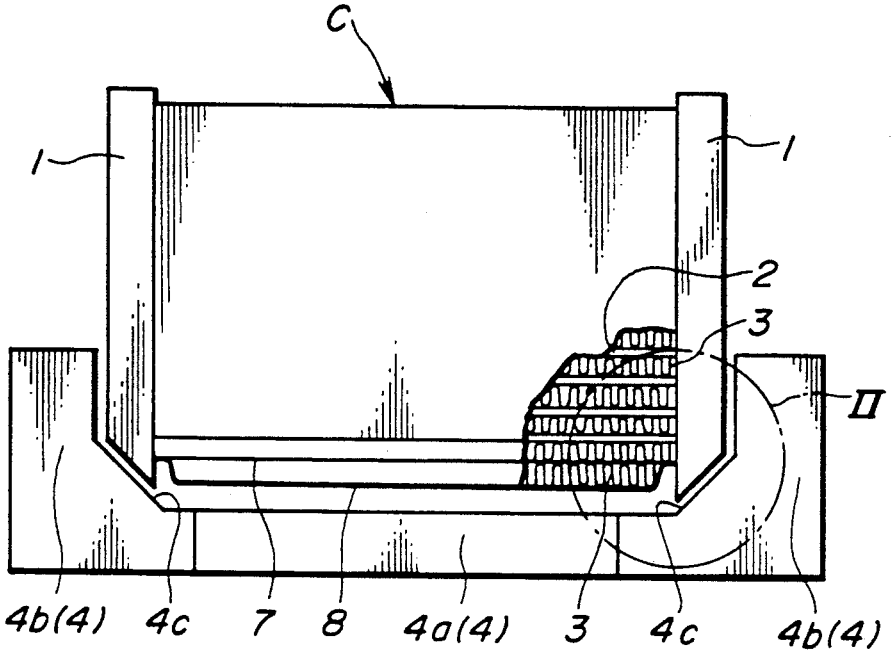
FIG. 1 is a front view illustrating a preferred embodiment of a condenser arranged on a cross member.

Referring also the drawings, wherein like reference numerals designate corresponding parts throughout the views, referring particularly to FIG. 1, a reference numeral C designates a condenser for an air conditioning system for an automotive vehicle which serves as a heat exchanger. The condenser C is arranged on a cross member 4 arranged in a cross direction of the vehicle.

Figure 2:
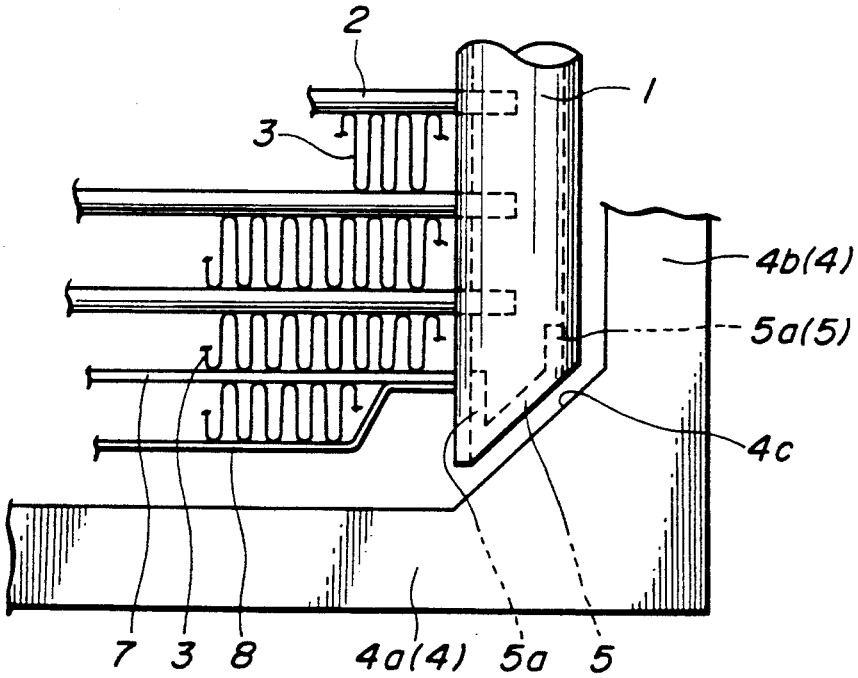
FIG. 2 is an enlarged view of a portion II in FIG. 1.
Figure 3:
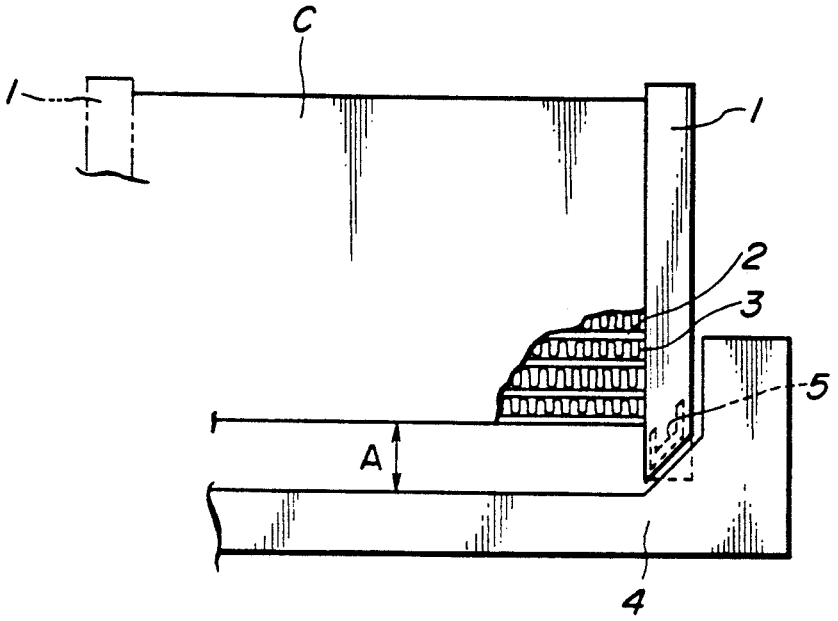
FIG. 3 (PRIOR ART)
FIG. 3 is a fragmentary front view illustrating a known condenser arranged on a cross member.
Figure 4:
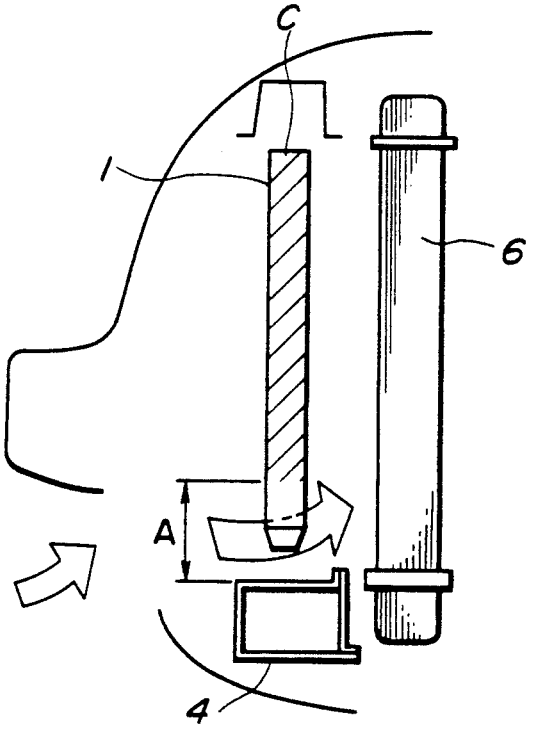
FIG. 4 (PRIOR ART)
FIG. 4 is a diagrammatic side view of the known condenser in FIG. 3.

Referring also to FIG. 2, the cross member 4 is formed to partly surround the condenser C in view of improvement of the rigidity of a vehicle body, etc., and includes a horizontal portion 4*a*, and vertical portions 4*b*. Corners 4*c* of the cross member 4 on the side of the condenser C are formed in an oblique manner.

The condenser C includes a pair of header pipes 1 on both sides thereof. Arranged between the pair of header pipes 1 are a plurality of tubes 2 which fluidly communicates therewith. Additionally, a plurality of fins (first group of fins) 3 are arranged between the tubes 2.

Each tube 2 has two ends inserted in the header pipes 1, respectively, and fixed thereto by soldering, etc.

Each header pipe 1 has a lower end obliquely cut to correspond to the corner 4*c* of the cross member 4, and having a opening to which a cap 5 having an U-shaped cross section is secured.

Due to the obstructive presence of a periphery 5*a* of the cap 5, the bottom tube 2 cannot be inserted in a lower end portion of each header pipe 1 at which the cap 5 is located. Accordingly, the bottom tube 2 is located slightly above the cap 5.

Arranged between the bottom tube 2 and the cross member 4 are two plates 7 and 8 for holding the fin 3 between the header pipes 1.

Specifically, the plate 7 is located below the bottom tube 2 at a first predetermined interval, whereas the plate 8 has two ends joined to the lower surface of the two ends of the plate 7, and a center portion located below the plate 7 at a second predetermined interval.

The two fins (second group of fins) 3 are fixedly held between the plates 7 and 8, and between the plate 7 and the bottom tube 2.

In this embodiment, the plates 7 and 8 for holding the fins 3 are positioned between the bottom tube 2 and the cross member 4, preventing the passage of air without contributing to heat release, resulting in the increase in efficiency of heat exchange of the condenser C.

Further, the presence of the plates 7 and 8 contribute to the increase in rigidity of the header pipes 1 due to the lower ends thereof as obliquely cut, and also the entirety of the condenser C.

It is to be noted that the present invention is not limited to the aforementioned embodiment, and various changes and modifications may be made in the present invention without departing from the spirit and scope thereof. The heat exchanger may not be a condenser, but a radiator, for example.

What is claimed is:

1. A heat exchanger comprising:

a cross member, said cross member having inner corner portions formed with an oblique plane;

a pair of header pipes arranged on said across member, each having a lower end formed to correspond to each of said inner corner portions;

a plurality of tubes arranged between said pair of header pipes, said plurality of tubes fluidly communicating with said pair of header pipes;

a plurality of fins divided into a first group and a second group, said first group being arranged between said plurality of tubes; and plate means for holding said second group, said plate means being arranged between said pair of header pipes at lower end portions thereof, said plate means including an upper plate and a lower plate, with a first fin arranged between said upper plate and the lowermost of said plurality of tubes and a second fin arranged between said upper plate and said lower plate.

* * * * *